United States Patent [19]

Laderach et al.

[11] 4,023,339

[45] May 17, 1977

[54] AUTOMATIC LOADING, UNLOADING AND TRANSFER DEVICE ON SPINNING MACHINES

[75] Inventors: Paul Laderach; Charles Michalet, both of Lyon; Jean Rigaud, Ecully, all of France

[73] Assignee: Rhone-Poulenc-Textile, Paris, France

[22] Filed: Aug. 6, 1974

[21] Appl. No.: 495,243

[30] Foreign Application Priority Data

Aug. 8, 1973 France ..... 73.29102

[52] U.S. Cl. ..... 57/53; 57/52; 104/91

[51] Int. Cl.[2] ..... D01H 9/10

[58] Field of Search ..... 57/34 R, 52, 53, 54; 104/88, 89, 91, 106

[56] References Cited

UNITED STATES PATENTS

| | | | |
|---|---|---|---|
| 3,116,586 | 1/1964 | Incham, Jr. | 57/52 |
| 3,123,967 | 3/1964 | Incham, Jr. | 57/52 |
| 3,768,241 | 10/1973 | Nelson et al. | 57/34 R |
| 3,773,191 | 11/1973 | Ishida | 57/52 X |
| 3,788,054 | 1/1974 | Haussmann et al. | 57/34 R |
| 3,791,125 | 2/1974 | Kawakami | 57/52 |
| 3,828,682 | 8/1974 | Klein | 104/91 |

*Primary Examiner*—John Petrakes
*Attorney, Agent, or Firm*—Sherman & Shalloway

[57] ABSTRACT

Automatic device for loading and unloading identical objects e.g. textile or yarn supports, on at least one machine and for conveying said objects between the machine, a take up area and a feed area for use particularly in the automatic doffing and donning operation of textile machines, and more especially, machines with vertical spindles, such as synthetic yarn drawing machines.

The device includes at least two groups of cars having gripping and laying means. The first group is used for removing treated objects e.g. bobbin with yarn winding thereon, from the machine and conveying them to a take up area, the second group for conveying objects to be treated e.g. empty bobbins, from the feed area and positioning them on the machine.

23 Claims, 8 Drawing Figures

AUTOMATIC LOADING, UNLOADING AND TRANSFER DEVICE ON SPINNING MACHINES

FIELD OF THE INVENTION

This invention relates to an automatic loading, unloading and transfer device on production or treatment machines. More particularly, this invention relates to the automatic doffing and donning of objects e.g. textile or yarn supports, on at least one machine and for the automatic transfer of said objects between a feed zone, the machine and a take-up zone, all three being stationary.

Such a loading, unloading and transfer device, may be used in many industries and especially as an auxiliary device to service textile machines. In the textile industry, the yarn, after production or treatment, is usually wound on a carrier such as a tube or bobbin. After the winding operation is completed, full packages have to be removed from the machine and empty carriers must be conveyed and placed in position on the machine. This operation is called doffing and donning. The objects to be handled in this case being full and empty yarn bobbins.

The doffing and donning problem is set at the same time for all machines on which the yarn is to be taken up on horizontal bobbins such as swing arm winders and for vertical spindle machines with a winding onto these spindles, such as drawing machines. However, this problem is much more important for the second type of machines which need more frequent carrier changes and for which, the yarn feed is stopped during doffing and donning.

BACKGROUND OF THE INVENTION

Until now, different solutions for automatic operations have been tried, but unfortunately, these solutions have not quite been satsifactory. It is well-known to fit every spindle group section of a drawing machine with an automatic doffing and donning system. This system consists in laying down full bobbins on a conveying belt which is moving in the lower part of the machine and in taking the empty bobbin from it. At the end of the machine, a device supplies a conveyor belt with empty bobbins and removes full ones. Such a doffing and donning device is described in French Pat. Nos. 1,455,716; 1,498,137 and 1,514,211; in U.S. Pat. No. 3,398,519 and in German application No. 2,225,673. However, these prior art devices exhibit certain drawbacks. The doffing and donning system is permanently stationary and several systems are necessary for a single machine, so that the construction of the machine is more complex and higher in cost, because every doffing and donning system is used only for a short period.

Prior art doffing and donning systems associated with means such as a conveyor belt to lay on and remove full bobbins and to supply empty ones have been previously disclosed such as in German application no. 1,510,593 and French Pat. No. 2,136,816. However, there are still two separated means used, one for doffing and donning, the other for conveying. In addition, the travel of the conveyor belt is inevitably limited, usually it does not go beyond the drawing step. Therefore, it is necessary to provide additional means to convey full bobbins from the lower end of the belt to the control or packaging device and means to convey empty bobbins from the preparation device to the upper end of the belt. The conveyor belt may be replaced by receptacles associated with the doffing and donning system and moving along the machine or from one machine to another as described in French Pat. Nos. 1,421,449 and 1,599,640 and in U.S. Pat. Nos. 3,447,297 and 3,344,539. However, additional means for the supply of empty bobbins and for the removal of full bobbins must be provided or else these operations have to be carried out by hand.

French Pat. No. 2,139,508 relates to an automatic doffing and donning device for swing-arm winders. The doffing and donning system travels along the machine and is associated with a conveyor system comprising a locomotive and of cars travelling along the machine. The automatic doffing system lays down full bobbins in cars according to their succession on the machine. At the machine end, cars are laid on a carriage and transported to the control and packaging device. This device comprises three separated means, at least, for the doffing and conveying step which requires transshipment. In addition, neither means for automatic unloading in the take-up area, nor means for the placing of the empty bobbins in position on the machine are provided.

SUMMARY OF THE INVENTION

This invention relates to an automatic device for loading and unloading identical objects e.g. empty and full bobbins or supported yarn windings, on a textile machine and for conveying said objects between the machine, a take-up station and a feed station. The device includes a guide circuit connecting the machine with a take-up station, a feed station and at least two means, such as cars or wagons, capable of travelling along the circuit and of standing still one after the other in front of the machine. The first means is fitted with a system for the simultaneous gripping of several objects, remove the objects from the machine and places them in the take-up area. The second means is fitted with a system for simultaneous gripping several objects, taking the objects to be treated from the feed station and then placing them in position onto the machine.

The guide circuit may be either a closed circuit, or an open circuit.

If the guide circuit is closed, both means travel in the same direction; preferably, the direction does not vary.

If the guide circuit is open, both means can move forwards or backwards.

Preferably, the gripping system for both means are identical so as to simplify the construction and allow their use indifferently at the first or second position. However, the invention is more advantageous when using two trains or groups of means. The first group removing treated objects and the second group of means placing the objects to be treated in position. Both groups allow all the work positions of the machine to be served simultaneously. In this case, every group may be composed of a number of cars ($n$) equal to the number of work sections of the machine and every car is then fitted with a system for simultaneously gripping a number of objects ($p$) equal to the number of work positions of each section. When a machine must be served with two work sides, two sets of groups are used, one for each side. In this case, it is necessary to provide a guide circuit which is divided into two sections at the machine level, that is, comprising a section to serve each side. Switch means are also provided for the connection of the sections with the machine.

In the same way, the device may be made suitable for serving a number of two sided machines arranged in rows and lines. It is generally sufficient to fit the installation with a guide circuit comprising a section for every row of machines and a section for the outer sides of the machines of both end rows and with switch means for the connection of the sections with the machines.

Preferably, the cars of every set of two groups are identical, one or the other group may be used at the first or second position, thus possibly, being advantageously used with a closed circuit. In this case, after service, the second group, which is then an empty group, may be used as a first group for removing the treated objects for the next loading of the machine or for the unloading of the following machine. The group which may remain empty in order to remove treated objects on the next unloading does not need to pass before the take-up area, nor before the feed zone. However, it may be placed in a position such that it may be directed straight to the machine to be served. To this end, the take-up and feed zones may be arranged in such a manner that by going over the circuit in the group's direction, the take-up area and then the feed area can be met after the machine. Then, an additional section may be provided for connecting two points of the main circuit. One of the points lying between the machine and the take-up zone and the other point lying between the feed area and the machine. A second guide-circuit which is shorter than the main circuit and borrows a part of the laying out of the last, that is, the part lying around the machine, is defined. The additional section is a temporary runway and/or siding for the car or the group of cars such as the empty cars coming from the machines.

The guide-circuit is preferably a rail, which may be either a ground rail or an overhead rail. Every car may include an autonomous driving means for its travelling and a central generating station supplying the energy necessary for driving the gripping systems and all the means required for operating the devices which are mentioned hereafter.

Preferably, the driving means consist of a tractor and the central station is an hydraulic power station. Advantageously, the tractor and hydraulic power station form a single element. The tractor may be on the ground or overhead. It may travel on the same circuit as the group of cars or on a separate circuit. Therefore, there is the possibility of having a group of cars guided on an overhead rail and a tractor on the ground, for example, which is remotely controlled by a conducting-wire underneath the ground. It is also possible to have a ground group of cars and an overhead tractor. Preferably, the groups can travel forwards and backwards, and are driven by the same driving means. The tractor then acts as the "pushing" element and coupling means are adapted for use between the tractor and first car. For loading and unloading, each car may be positioned by use of bolting means. Preferably, the cars are bolted at the upper and lower parts of the car. Bolt driving may be carried out by any means, such as, by use of hydraulic jacks. Every car may be fitted with a conventional type of gripping system. As previously mentioned, the gripping systems of all wagons are preferably identical.

Also, preferably, the device of this invention is used for the doffing and donning operations of textile machines, and in particular, textile machines fitted with vertical spindles such as drawing machines for synthetic yarns. The gripping system preferably includes a number of grips fitting into the end of the cop. Preferably, the grips are mounted on a rail which is interchangeable according to the type of carrier and/or the distance between the spindle centers. The rails may be articulated on two pivoting arms. The arm motion for the gripping, the lifting and the laying of the bobbins may be driven by means such as hydraulic jacks. Means may be provided for guiding the rail motion with the precision required for the gripping and laying on of cops. These means may, for example, consist of a curvilinear slide which is integral with the car or of a pantograph system comprising an arm connected to a rail and following the curve of a stationary cam having a profile calculated as a function of the motion to be obtained. Guide means are preferably interchangeable so as to adapt the rail and grip motion to the sizes and to the arrangement of the bobbins to be doffed and donned. Each gripping system may be fitted with means for holding the bobbin base in position during the transport either from the feed area towards the machine, or from the machine towards the take-up area. These means are preferably interchangeable and consist of a bar on which the yarn bobbin base lies. Preferably, means for detecting the presence of the bobbins are mounted on said bar.

The cars may be joined together by use of coupling means which, in the case of textile machines with vertical spindles, may be equipped with means that vary the distance between two cars. These means act so that in a doffing operation, when the cars are at rest, the distance between the two grips lying at the ends of two successive cars is equal to the distance between the spindle centers. When the groups are travelling, the distance between two cars is generally increased in order to avoid collision of the two packages placed at the ends of two successive cars or of the cars themselves colliding on passing through curves. This extensible, rigid coupling system may consist of links, bars or a jack system, which performs its function in both directions of the car's travel, when the cars have to travel in both directions.

Preferably, the car and its group motion, as well as the gripping, coupling, bolting and switching system operation is automatically driven by a program incorporated and synchronized with the machine to be served.

The device according to the invention offers a great advantage, particularly with regard to its simplicity. Indeed, a single element, such as a car, is used at one and the same time for loading or unloading and for transferring objects. Also, in the service of textile machines, transfers may be provided between doffing or donning means and transport means. Identical means may be used for removing full bobbins and for placing empty bobbins in position. Therefore, a single car model is sufficient.

A full shop of machines with two work sides can be served by means of a network of adapted rails and a series of about four identical groups of cars.

Also, the whole operation can be easily automatized by means of an incorporated program and synchronized with the running of the machines to be served.

For a better understanding of the invention, reference is herein made to the accompanying drawings wherein:

DESCRIPTION OF THE PREFERRED EMBODIMENT

Figure 1:
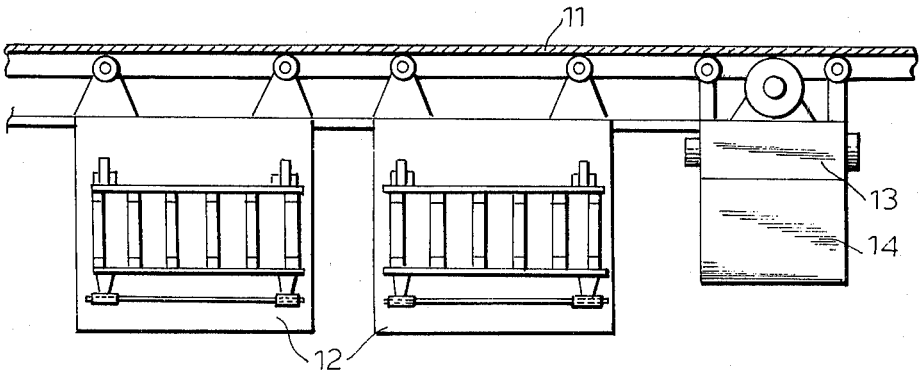
FIG. 1 is a partial schematic view of a group of cars for the doffing and donning of a textile machine in accordance with this invention.
Figure 7:
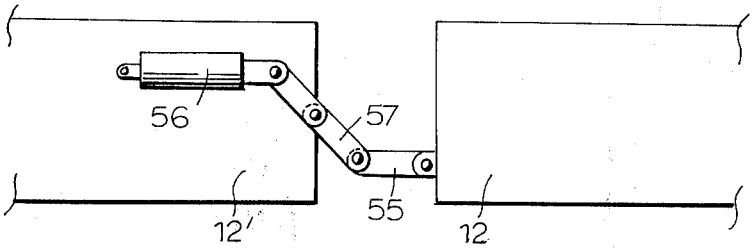
FIG. 7 is a schematic top view of the car coupling system according to the present invention.
Figure 8:
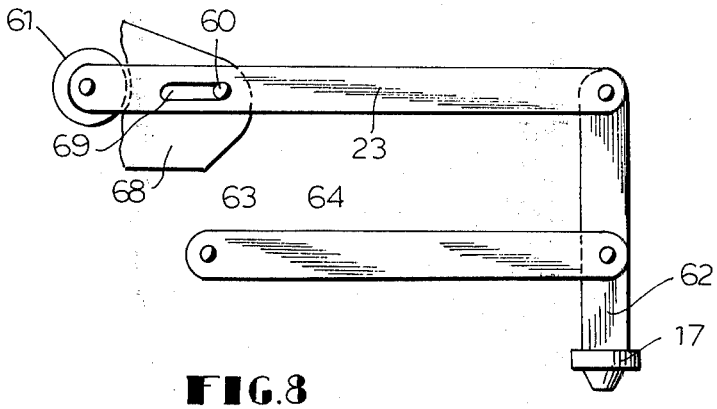
FIG. 8 is a schematic view of a rail motion guide device carrying the means of bobbin gripping according to the present invention.

In FIG. 1 there is illustrated a doffing, donning and transport device which consists of a group of cars travelling on an overhead rail 11. The group consists of cars 12 which are fitted with a cop gripping system. The group is pulled by an overhead electro-hydraulic tractor 13 with a pneumatic friction driving system. An autonomous hydraulic power station 14 is incorporated in the tractor for supplying the energy necessary to the various doffing and donning operations. The tractor 13 and power station preferably form a single element as shown. The power station 14 is driven by an incorporated program which is synchronized with the machine to be served, which, for example, may be a synthetic yarn drawing machine. If the drawing machines to be served consist of twelve sections, with each of them having six spindles, there may be provided twelve identical cars including means for the simultaneous gripping of six cops. The cars are preferably joined by a coupling system which allows a variable distance between them as illustrated in FIG. 7. It may comprise a coupling bar 55, articulated on the car 12, of a jack 56 pivotally mounted on the car 12', and of a link 57 articulated at a fixed point of the car 12' and connected by its extremities to bar 55 and to jack rod 56 respectively. The distance between the cars is kept to a maximum during group movement. The cars and the gripping system of the present invention are more evident in FIGS. 2 and 3. Gripping means are used comprising six grips 15 capable of entering into the end of cops 47. The tightening and untightening of the grips are controlled hydraulically from the power station 14. As shown, six grips may be mounted on a rail 17 which is articulated by its extremities on two arms 18 and 19. The arms 18 and 19 are preferably pivotable around a common shaft 20, parallel to rail 17 and to spindle line 21. The pivoting of arms 18 and 19, is by use of jacks 22, which themselves are driven by the hydraulic power station 14. The pivot of the arm 18 and 19, and rail 17 is controlled by a pantograph system. The arm 23 of the system is connected to the rail 17 following the curve of the stationary cam 68 which reproduces the profile of the movement to be obtained. This system is illustrated in detail in FIG. 8. The arm 23 is fitted with a slideway 69 which can slide and pivot round a fixed shaft 60. The arm 23 rests through a roll 61 on the fixed cam 68 and is connected to the rail 17 by a bar 62 which is articulated on the rail. The bar 62 is on the other hand connected to a staionary shaft 63 by an arm 64. The means maintaining the base of cops 37 consist of a longitudinal bar 25 fitted with housings 65 for the base of cops 47 and fixed on the arms 18 and 19. Means detecting the base of cops, for example microswitches, not illustrated, may be provided in housings 65. Every car may be fitted with a means for positioning and bolting or immobilizing it in a doffing or donning position at its top and/or at its base. These retractable means may be articulated on the car by hydraulic jacks and they may be inserted in a suitable housing. At the top of the car, they consist of at least one or preferably two rollers 26, mounted on a retractable rod which may be inserted in a V-ramp 29 fixed on rail 11. At the car's base are provided bolting means comprising two pins 27 and 28, which are integral with the pivoting arms 32 and 33. The pins 27 and 28 may be inserted in holes 30 and 31 that are pierced in plates integral with the drawing machine. The motion and the blocking in position of the arm 32 and 33 are driven by jacks 34 and 35.

Figure 2:
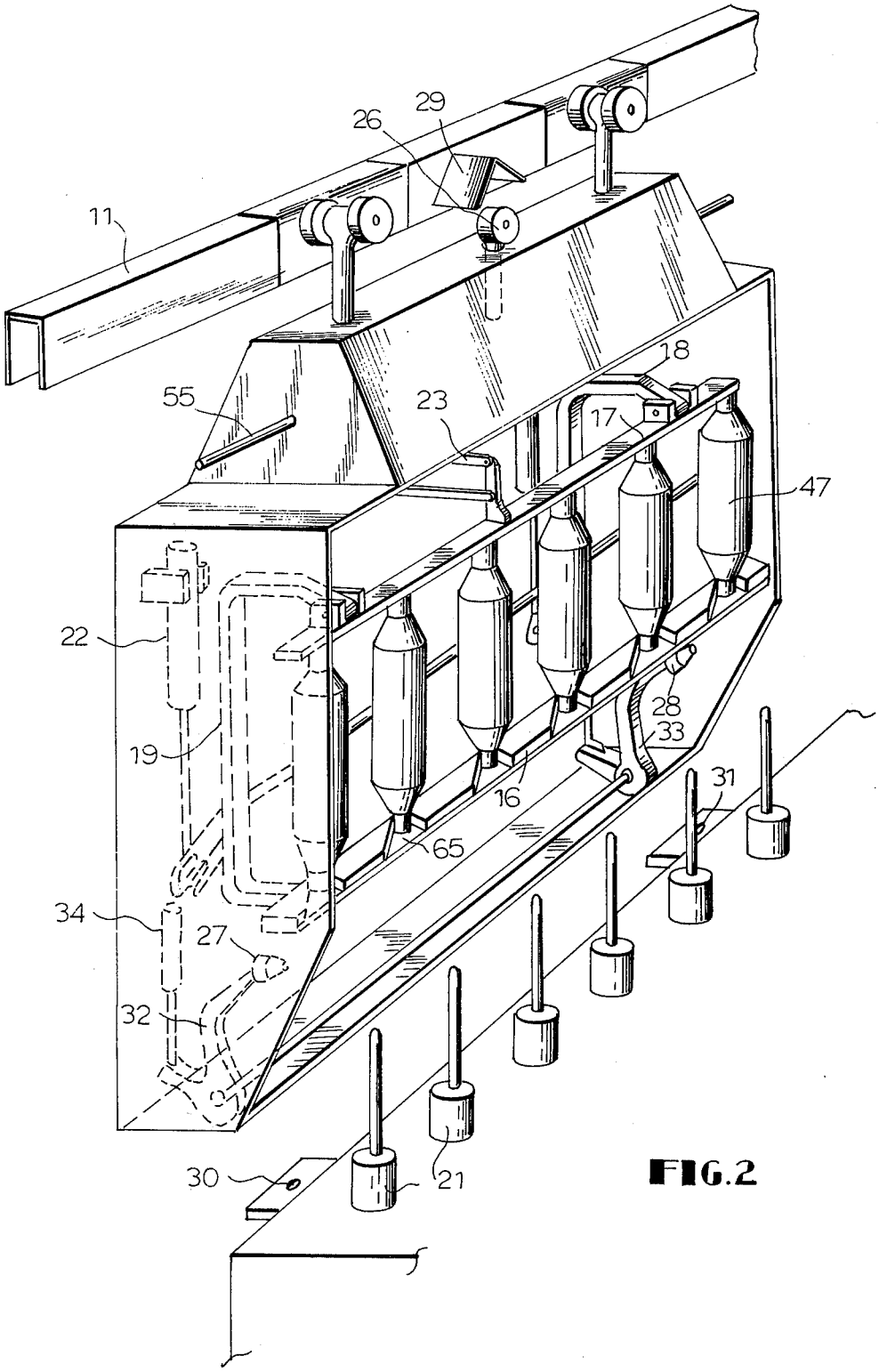
FIG. 2 is a plan view of a car according to the present invention showing the gripping system illustrated after the removal of full bobbins.

In FIG. 2 is shown full cops which have just been removed from spindles whereby the pins 27 and 28 and the roller 26 are retracted and the group can move.

Figure 3:
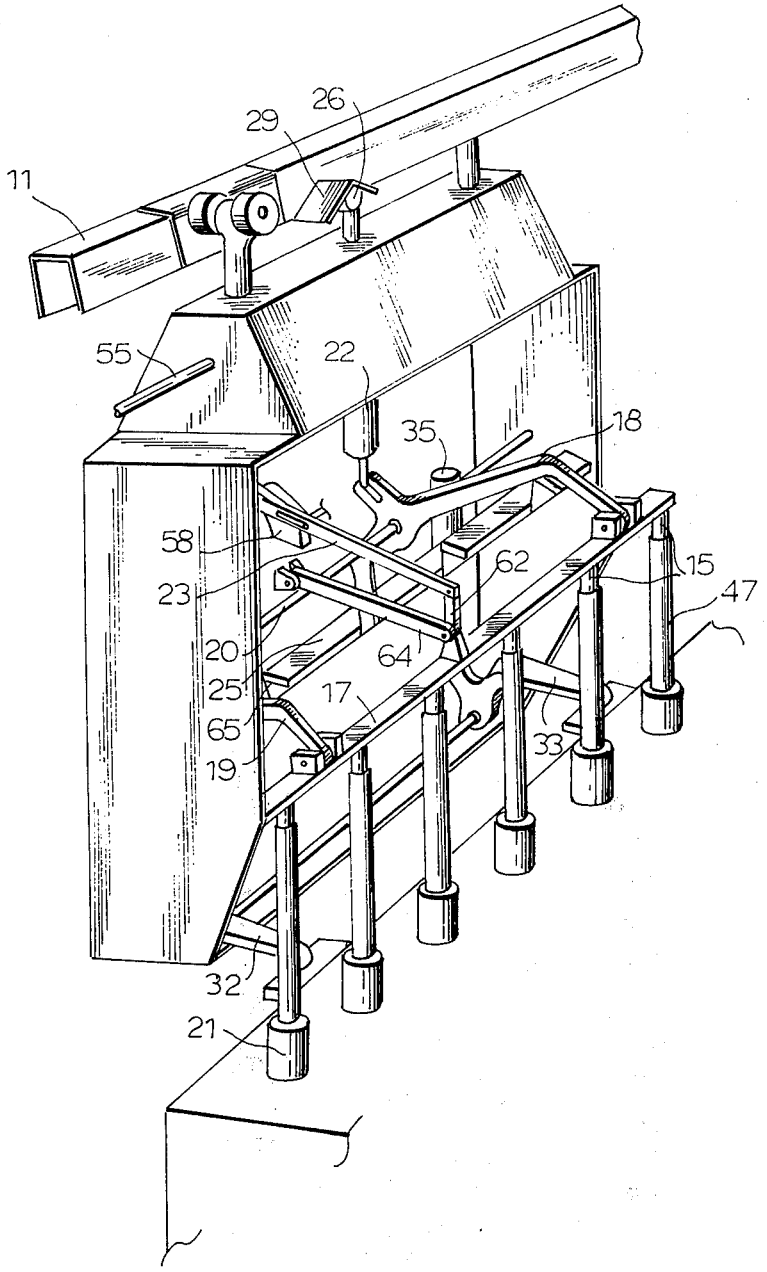
FIG. 3 illustrates a car as shown in FIG. 2 during the placing in position of empty bobbins.

In FIG. 3, a car is shown in the phase of placing empty cops in position. The pins 27 and 28 and the roller 26 are inserted in their respective housing. In this position, as well as in the position of removing full cops, the distance between the cars is minimal. Each car is then perfectly positioned and maintained in front of its spindle group section by the positioning and bolting means. The coupling means are preferably "made free" and the working of jacks shown in FIG. 7 are not needed.

Figure 4:
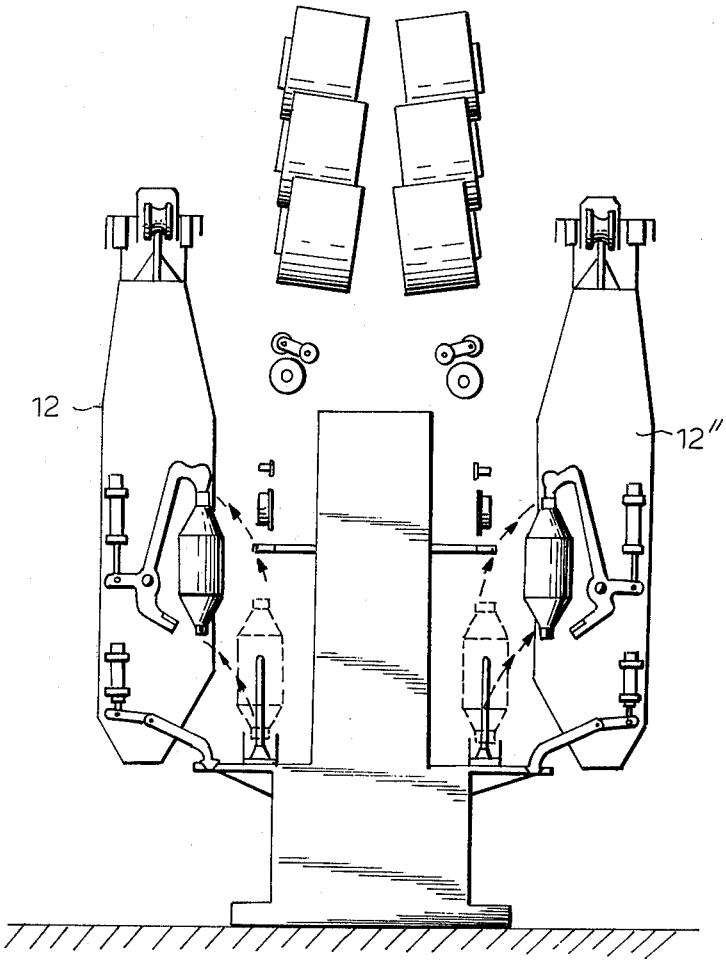
FIG. 4 is a sectional view of a drawing machine during the doffing and donning operation.

FIG. 4 is a sectional view of a double side of a drawing machine during movement of the full cops. A group of cars is used for each side of the drawing machine. Both groups, from which two cars 12 and 12', run simultaneously are shown.

Figure 5:
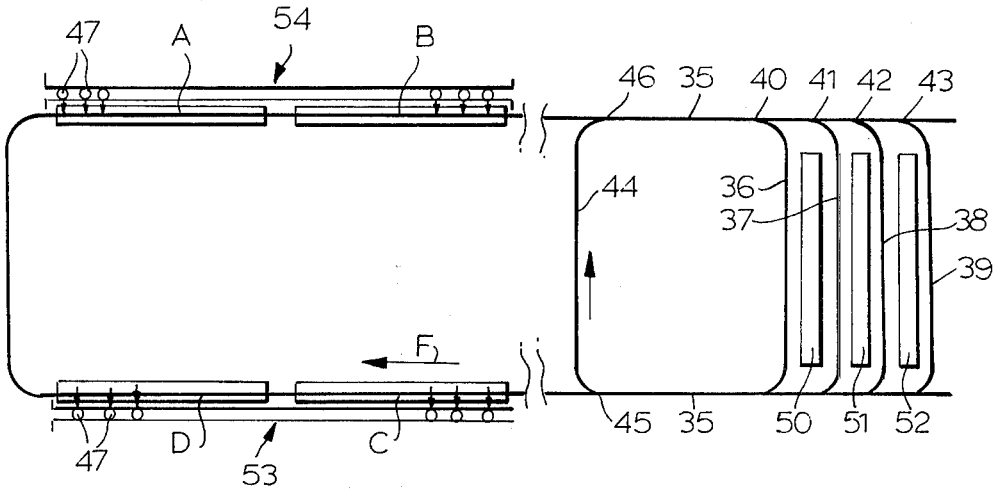
FIG. 5 is a veiw of a closed guide circuit of the device according to the present invention for the service of a textile machine shop.

FIG. 5 is a schematic view of a guide circuit for the service of a drawing shop with the drawing machine being arranged in one row after the other. Three double-sided drawing machines 50, 51 and 52, a full cop take-up area 53 and an empty cop feed area 54 are illustrated. A guide circuit 35, comprising an overhead rail 10, connects the take-up zone 53, the drawing machines and the feed zone 54. The shop is served by four groups of cars A, B, C, D, which travel along the circuit in the direction of the arrow F. At the drawing machine level, the circuit divides into several sections, such as the four sections 36, 37, 38, 39 for the service of the three drawing machines 50, 51, 52, Switches 40, 41, 42, 43 are provided at the junction points of the sections 36, 37, 38, 39, before the drawing machines. An additional section 44 connects two points 45 and 46 of the circuit 35 lying before and after the machines respectively. A switch is provided at the point 45 and the section 44 has a temporary runway and/or siding for the group of empty cars coming from the machines.

Figure 6:
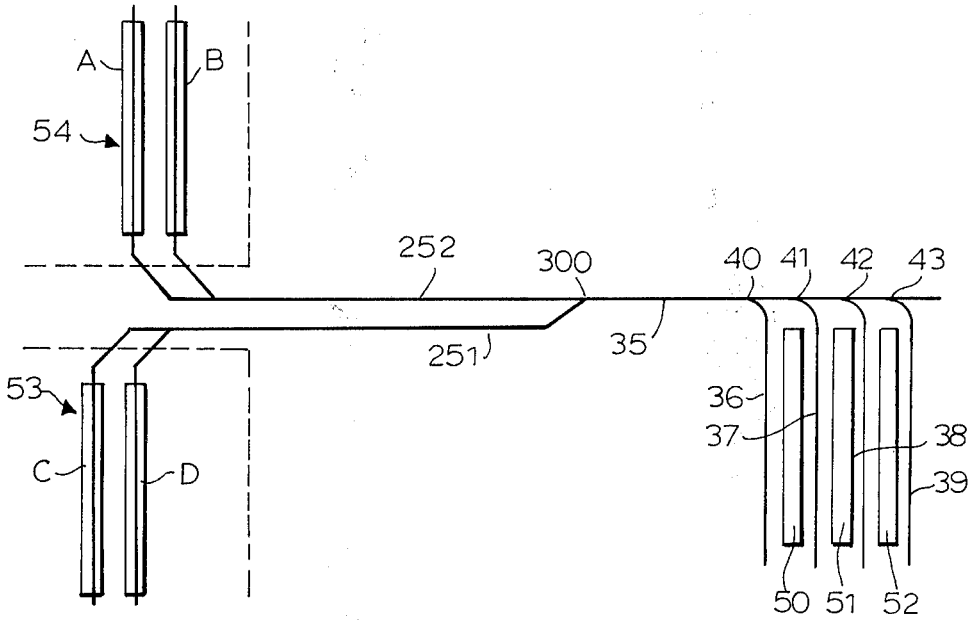
FIG. 6 is a view of an open guide circuit of a device according to the present invention.

FIG. 6 schematically illustrates an open guide circuit for the service of a drawing shop having double sided drawing machines arranged in a row one after the other. The open circuit 35 comprises two sections 251 and 252, connecting the machines to the take-up area 53 and to the feed area 54 respectively. A switch 300 may be provided at the junction of sections 251 and 252. The trains A, B, C, D, move forwards and backwards, A and B on the section 252, C and D on the section 251.

The working of the device in an installation according to FIG. 5 is as follows:

As seen, the drawing machine 50 during the donning and doffing operation may have groups of cars C and D with full cops removed from the drawing machine 50 and in the take-up area 53 which may be a control-sorting shop where the cops are unloaded, for example, on the conveyor belt. Meanwhile, groups A and B may be loaded with empty cops in the feed station 54. Loading and unloading of cops may be carried out by means wherein the systems of every car are gripping. Groups A and B may start towards the drawing machine 50 with group A going up the section 36 and group B going up section 37. Groups A and B may come to a stop in front of the drawing machine 50 for the donning operation. Groups C and D, after unloading in the area 53, go to the area 54 where they are loaded with empty cops. After the cops have been put in their place on the drawing machine 50, the doffing and donning operation on this machine is ended. Empty groups A and B are then directed toward the section 44 and stopped along this section in a waiting position. When it is time to carry out the doffing and donning operations of the drawing machine 51, the groups A and B leave the section 44 and go up the circuit 35. Then group A goes up the section 37, group B goes up section 38 and both groups stop on these respective section for removal of the full cops from the drawing machine 51. Both groups A and B which are loaded with full cops are directed towards the take-up area 53. Groups C and D which are loaded with empty cops are directed towards the drawing machine 41 for the donning operation. The cycle start over again with groups C and D which are now empty coming to a waiting position at section 44 with a view to the next donning and doffing operations of the next drawing machine 52.

The device operates in an installation according to FIG. 6 as follows:

As illustrated, the drawing machine 50 to be donned and doffed has empty groups C and D leaving the take-up area one after the other and directed torward the drawing machine 50 by sections 251 and 252. Group C goes up section 37 and group D goes up section 36. Both groups come to a stop in front of the drawing machine 50 for removal of the full cops from the machine. Meanwhile, groups A and B which are loaded with empty cops come to a waiting position at section 252. After doffing, groups C and D start backwards toward the take-up area 53. When the groups have overtaken the switch 300, groups A and B start toward the drawing machine 50. Group A goes up section 36 and group B goes up section 37. After donning, groups A and B start backwards toward section 54.

Preferably, the above mentioned operations described in FIGS. 5 and 6 are automatized and controlled by an incorporated program, synchronized with the drawing machine to be served.

EXAMPLE:

The device according to FIGS. 1 to 5 and 7 to 8 may be used for the doffing and donning operations in a drawing shop in which there are 20 machines. The average distance from the shop to the take-up area, such as a packaging area, and to the feed zone is about one hundred meters. Each double sided drawing machine comprises twelve groups of six spindles per side, that is, seventy-two spindles. A polyester yarn with a global count of 145 dtex/44 filaments is drawn. The yarn is wound onto cops 420 mm long. Packages of 4 kg from which 0.5 kg for the carrier are made. This package is 145 mm in diameter as a maximum. The winding time is about 8 hours. The operations of doffing, donning and transport of full and empty cops are carried out by four groups of twelve cars, each car having six gripping elements. The groups are moving at a progressive speed from 0 to about 50 meters per minute. The time stop of each machine necessary for doffing and donning is about 3 minutes.

It is understood that this invention is not limited to the described example. It may offer many variants, with regard to the cars, the gripping means and their control, the guide circuit, the train driving means, and so on.

This invention may be applied to the loading, unloading and automatic transport on machines. It is more particularly well adapted to the operations of doffing and donning of textile machines.

Although the present invention has been described with reference to particular embodiments and example it will be apparent to those skilled in the art that variations and modifications can be made without departing from the principles and spirit of the invention.

What is claimed is:

1. An automatic device for donning and doffing bobbins on at least one textile machine and for transporting said bobbins between a textile machine, a take-up area of full bobbins and a feed area of empty bobbins, comprising a guide circuit connecting the textile machine to said take-up area and to said feed area, and at least two independent means capable of traveling along the circuit and of stopping one after the other in front of the textile machine, the first means being fitted with a gripping means for simultaneous gripping of several bobbins and for the removal of said bobbins from the textile machine and for placing them on the take-up area, the second means being fitted with a gripping means for simultaneously gripping several empty bobbins from the feed area and positioning them on the textile machine. .

2. The device of claim 1, wherein said gripping means are identical.

3. The device of claim 1 having a single side of $n$ work sections, each of said sections being fitted with $p$ work positions, comprising a group of $n$ cars for the removal of the full bobbins and a group of $n$ cars for the positioning of the empty bobbins, each of said cars having a system for the simultaneous gripping of $p$ bobbins.

4. The device of claim 1 having two sides of $n$ work sections, each of said section being fitted with $p$ work positions, said guide circuit having a section for the service of each side of the machine, a group of $n$ cars for the removal of the full bobbins and a group of $n$ cars for the positioning of the empty bobbins, each car having a system for the simultaneous gripping of $p$ bobbins.

5. The device of claim 4 for the service of a series of machines having two work sides arranged in rows and lines, wherein said guide circuit includes a section for each row of machines and a section for the external side of the machines of the two end rows, and switching means at a connecting section before the machines.

6. The device of claim 5, in which the circuit is closed.

7. The device of claim 6, in which the groups travel in the same direction and this direction is always the same.

8. The device of claim 7, in which said take-up area lies before said feed area and comprises a second closed guide circuit which is shorter than the first circuit and is laid out around the machine, said second circuit being defined by a part of the first circuit and by an additional section connecting a first point lying between the machine and a take-up area to a second point lying between the feed area and the machine, including switching means for the junction of both circuits at said first point.

9. The device of claim 8, in which the additional section consists of a temporary runway for at least one car coming from the machine.

10. The device of claim 1 in which the guide circuit is open.

11. The device of claim 10, in which said means capable of traveling along the circuit are cars which are capable of moving forwards and backwards.

12. The device of claim 1 wherein said guide circuit is a ground rail.

13. The device of claim 1 wherein said guide circuit is an overhead rail.

14. The device of claim 1 in which every means capable of traveling along the circuit is provided with means for positioning and stopping said traveling means in the loading and unloading positions.

15. The device of claim 14, wherein said guide circuit is an overhead rail and said means for positioning and stopping in a loading amd unloading position comprise at least one sliding arm carrying a roller which fits into a V-ramp integral with the overhead rail.

16. The device of claim 1 including vertical spindles on each said textile machine and wherein said gripping means comprises a series of grips, each one fitting into the end of a bobbin, said grips being mounted on an interchangeable rail, articulated on two pivoting arms and interchangeable means for guiding the rail motion.

17. The device of claim 16, in which said interchangeable guide means consists of at least one curvilinear slide.

18. The device of claim 17, in which said interchangeableguiding means consists of a pantograph system comprising an arm connected to the rail following the curve of a fixed cam reproducing the profile of the motion to be obtained.

19. The device of claim 1, in which gripping system comprises interchangeable means for holding the base of bobbins during the transport.

20. The device of claim 19, in which the means for holding the base of bobbins in position consists of a supporting bar.

21. The device of claim 20 including means for detecting the presence of bobbins mounted on the means holding the carrier base.

22. The device of claim 1 wherein said means capable of traveling along the circuit are cars, a coupling system joining said cars, said coupling system fitted with means allowing the distance between two cars to be varied.

23. The device of claim 1 which further comprises a tractor for driving said means capable of traveling along the circuit and a central power station which supplies the energy necessary for controlling the gripping means.

* * * * *